United States Patent [19]

Gujer et al.

[11] Patent Number: 4,519,115

[45] Date of Patent: May 28, 1985

[54] METHOD OF THREADING A THREAD INTO A TEXTURING NOZZLE

[75] Inventors: Peter Gujer, Winterthur; Dieter Guldenfels, Dinhard; Armin Wirz, Ossingen, all of Switzerland; Hans Knopp, Ludwigshafen, Fed. Rep. of Germany; Dieter Herion, Frankenthal, Fed. Rep. of Germany; Gerhard Conzelmann, Otterstadt, Fed. Rep. of Germany

[73] Assignee: Rieter Machine Works, Ltd., Winterthur, Switzerland

[21] Appl. No.: 477,317

[22] Filed: Mar. 21, 1983

Related U.S. Application Data

[62] Division of Ser. No. 185,906, Dec. 11, 1979, Pat. No. 4,416,041.

[30] Foreign Application Priority Data

Apr. 21, 1978 [DE] Fed. Rep. of Germany ..... 2817487
Mar. 24, 1979 [EP] European Pat. Off. ..... 79/00019

[51] Int. Cl.[3] ..... D02G 1/12; D02G 1/16

[52] U.S. Cl. ..... 28/255; 28/256; 28/272

[58] Field of Search ..... 28/255, 256, 257, 272; 57/279

[56] References Cited

U.S. PATENT DOCUMENTS

| | | | |
|---|---|---|---|
| 3,424,359 | 1/1969 | Houle et al. | 28/255 X |
| 3,656,214 | 4/1972 | Ozawa et al. | 28/257 |
| 3,837,052 | 9/1974 | Martin et al. | 28/272 |
| 4,073,421 | 2/1978 | Reufer | 28/272 X |
| 4,240,187 | 12/1980 | Herold et al. | 28/255 |
| 4,356,603 | 11/1982 | Biot et al. | 28/255 |
| 4,356,604 | 11/1982 | Martin et al. | 28/255 |

FOREIGN PATENT DOCUMENTS

| | | | |
|---|---|---|---|
| 907402 | 7/1961 | United Kingdom | 57/279 |

*Primary Examiner*—Robert R. Mackey
*Attorney, Agent, or Firm*—Kenyon & Kenyon

[57] ABSTRACT

The invention concerns a method of threading in a thread into a texturing nozzle known as such, and an apparatus for implementing the method. The texturing nozzle is brought from a working position into a threading-in position for threading-in, in which position a treatment chamber provided with slots and located upstream from the outlet opening of the texturing nozzle is subject to a vacuum for sucking in a thread brought to a position in front of the inlet opening of the texturing nozzle.

1 Claim, 8 Drawing Figures

1
3
6
4
8a
8
7
10
9
46
A
11
5
16
17
18
44
B
47
2
45
13
12
14
1a
15
43
C
D

Fig.2
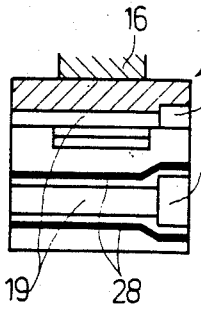
Fig.3
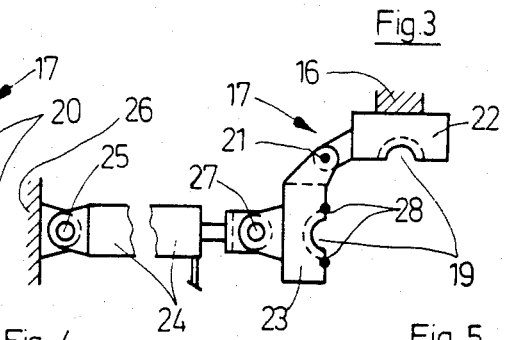
Fig. 4
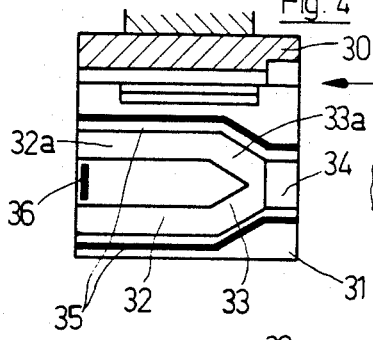
Fig. 5
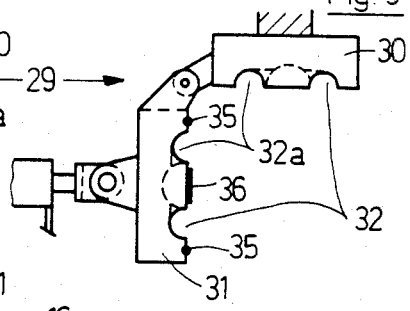
Fig. 6
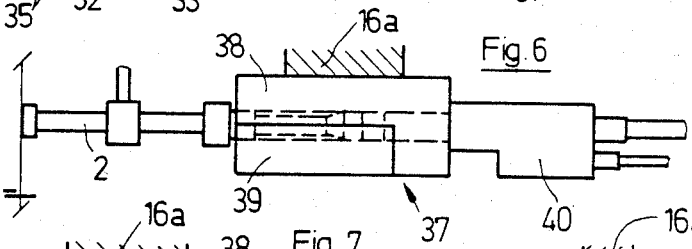
Fig. 7
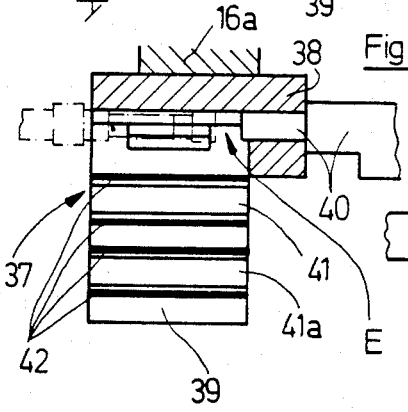
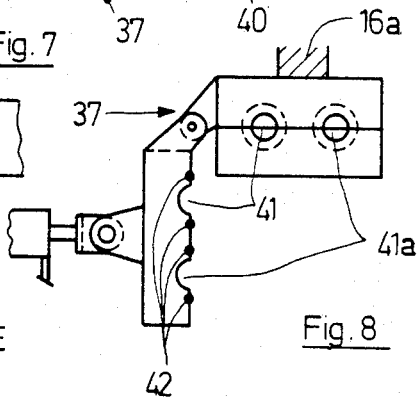
Fig. 8

METHOD OF THREADING A THREAD INTO A TEXTURING NOZZLE

This is a division of application Ser. No. 185,906 filed Dec. 11, 1979, now U.S. Pat. No. 4,416,041.

The present invention concerns a method and an apparatus for threading in a running thread into a texturing nozzle.

In threading in a thread during the start-up of a draw-texturing machine, the thread is taken manually off a creel bobbin package, i.e. the thread is not supplied continously. In this process, the thread introduced and inserted manually into the inlet opening of the texturing nozzle is sucked through the texturing nozzle by a suction gun placed onto the thread exit opening of the texturing nozzle and subsequently is transferred to the following elements involved in the texturing process using the suction gun which continually takes up the thread.

The manual method described above is not applicable, however, to such texturing nozzles used on a spin-draw-texturing machine, as on this machine a thread is supplied at the operational speed already right from the start of the machine.

A draw texturing method already is known, in which a running thread is pulled into and through the narrow thread passage duct of an air jet texturing nozzle using a wire loop inserted through the thread passage duct (U.S. Pat. No. 3,837,052). Such threading-in is tedious, as the thread first is to be pulled through the wire loop using two suction guns. Furthermore, the speed of pulling the wire loop through the nozzle is not sufficient at high thread supply speeds, such that threading-in is not effected successfully. The means required for generating the high acceleration of the wire loop are complicated and susceptible to defects. A further disadvantage is seen in the danger of damage to the inside of the texturing nozzle by a bent wire loop.

In order to facilitate insertion of the thread, it has also been proposed such as described in British Pat. No. 1,482,985, to use a nozzle inlet opening with an adjustable width. However, a detachable inside member is required for such an arrangement. Thus, the nozzle inlet is of complicated design and a high degree of manual skill of the operator is required.

It thus is the object of the present invention to create a method and an apparatus in which a continuously supplied thread in most simple and reliable manner is threaded in and pulled through the texturing nozzle and is transferred to the elements without any additional member to be provided on the nozzle itself and without pulling through being required.

Briefly, the invention provides a method and apparatus of threading a thread into a texturing nozzle.

The method includes the steps of threading a running thread into a texturing nozzle by manually guiding the thread at a right angle into the immediate vicinity in front of a thread inlet opening of the nozzle and bringing the thread to a cutting device using a mobile suction device. In accordance with the invention, the thread is severed, caughty by a suction air stream entering the inlet opening of the nozzle and is guided through the nozzle to a suction device which generates the suction air stream.

In accordance with the method, a plurality of threads may be run separately and may be caught in individual openings of the nozzle for guidance to a common suction device.

The apparatus of the invention comprises a texturing nozzle for texturing a moving thread and which has a thread inlet opening at one end, a suction device for selectively generating a suction air stream within the nozzle, a cutting device for cutting a thread and a mobile suction device for guiding a thread at a right angle in front of the inlet opening of the nozzle and into the cutting device downstream of the nozzle.

The nozzle also includes a thread outlet opening at an opposite end and a plurality of lateral outlet openings between the inlet opening and the outlet opening. Further, the nozzle is movable between a threading-in position with the inlet opening adjacent the cutting device and the outlet opening in communication with the first suction device and a texturing position. In addition, the apparatus includes a closable device which is movable between a closed state forming a sealed duct about the lateral openings of the nozzle and extending to the first suction device and an open state to permit movement of the nozzle from the threading-in position to the texturing position.

The suction device can be provided as an integrated suction device which is tilted open for taking up the texturing nozzle, or as a mobile suction gun held in a holding device which is tilted open.

If a suction gun is used, the ducts taking up the texturing nozzles can merge upstream from the suction gun, in such manner that all threads are caught by one single suction gun.

The invention is described in more detail in the following with reference to illustrated design examples.

FIG. 2 illustrates a front view of an apparatus of the texturing machine according to FIG. 1 shown opened;

FIG. 3 illustrates a side view of the apparatus according to FIG. 2;

FIG. 4 illustrates a front view of an alternative design example of the apparatus according to FIG. 2, shown opened;

FIG. 5 illustrates a side view of the apparatus according to FIG. 4;

FIG. 6 illustrates a front view of the apparatus of the texturing machine according to FIG. 1, shown with the texturing nozzle;

FIG. 7 illustrates a front view of the apparatus according to FIG. 6, shown opened; and FIG. 8 illustrates a side view of the apparatus according to FIG. 7.

Figure 1:
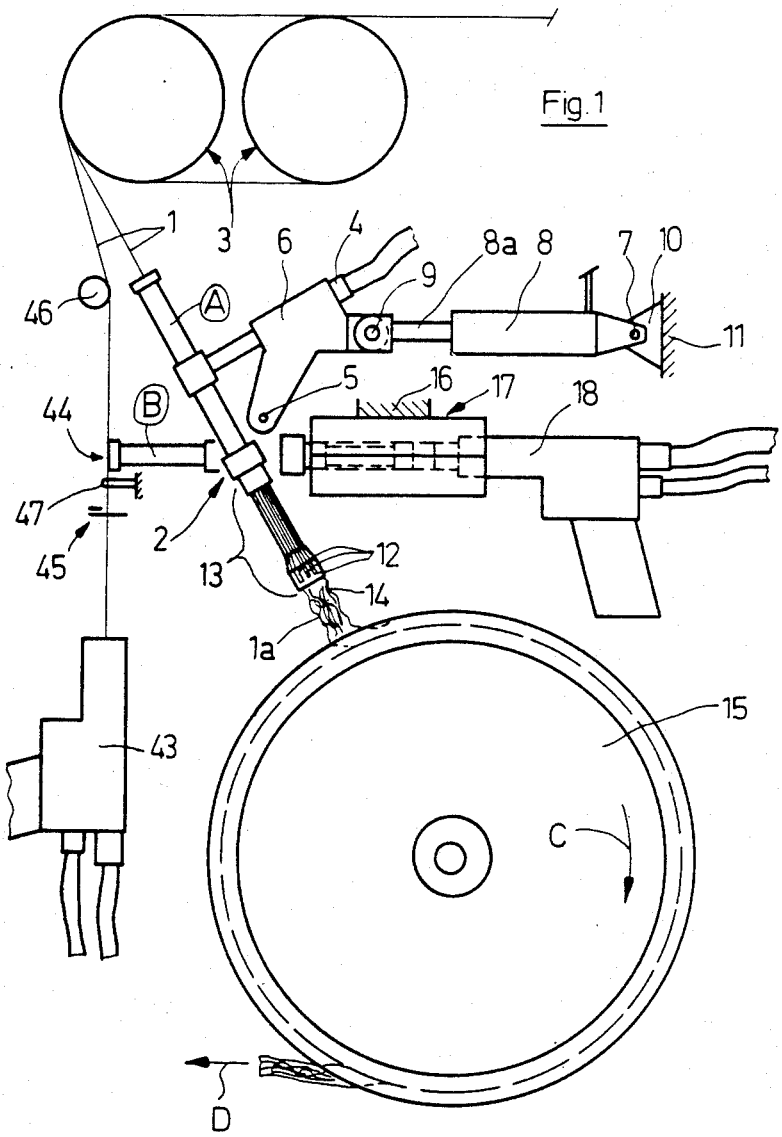
FIG. 1 illustrates a partial, semi-schematic view of a texturing machine.

The partial view of the texturing machine according to FIG. 1 shows a not yet textured thread 1 supplied to a texturing nozzle 2 by a pair of drawrolls 3. The texturing nozzle 2 is held via its supply duct 4 in a holder 6 which is pivotable about a hinge pin 5 from a texturing position A into a threading-in position B. The pin 5 is rigidly mounted in a machine frame member (not shown). A controllable pneumatic cylinder 8, pivotable about a hinge pin 7, and its piston rod 8*a*, respectively, is pivotably connected via a further hinge pin 9 with the holder 6. A support member 10 taking up the pin 7 is rigidly connected to a machine frame member 11. The texturing nozzle 2 comprises a treatment chamber 13, known from U.S. Pat. No. 3,714,686 and provided with the slots 12 and with a delivery opening 14 for the thread 1*a* textured while passing through the nozzle.

The textured thread 1*a* after emerging from the texturing nozzle 2 is deposited onto a cooling drum 15 which rotates in the direction of arrow C, and leaves this drum again in the direction of arrow D to be transferred by a mobile suction gun 18 onto the subsequent elements (not shown) also involved in the texturing method. An apparatus 17 mounted on a machine frame part 16 is provided with a duct part 19 and 20, respectively (FIG. 2), each substantially sealingly surrounding the treatment chamber 13 and the insertable mobile suction gun 18. The duct parts 19 and 20 together form a continuous duct. The device furthermore comprises two housing parts 22, 23 (FIGS. 2 and 3), which can be pivoted open about a hinge shaft 21, in which arrangement the upper part 22 is rigidly connected with the machine frame part 16 and the lower part 23 can be pivoted down, i.e. towards the cooling drum 15. Pivoting of the lower part 23 is effected by a controlled (not shown) pneumatic cylinder 24, which on one side is connected, via a hinge pin 25, with a stationary machine frame part 26, and which is linked on the other side via a hinge pin 27 to the pivotable part 23. In the lower part 23, seals 28 are provided at the right hand side and the left hand side of the duct parts 19 and 20 for avoiding penetration of air from the outside into the duct parts.

In FIGS. 4 and 5, an apparatus 29 is shown as an alternative design example differing from the apparatus 17. The difference is seen in that using only one mobile suction gun one thread each can be inserted into, or pulled through respectively, two texturing nozzles simultaneously.

The upper part 30 of the apparatus 29 and the lower part 31 in their closed state form the duct parts 32 and 32*a*, respectively, each of which substantially seals and surrounds a treatment chamber 13. In addition, the duct parts 32, 32*a* have duct parts 33, 33*a* which merge into each other into a common duct part 34 which surrounds the mobile suction gun (not shown). Lateral penetration of air from the surrounding room along the duct parts is prevented by seals 35 and 36. The other parts of this apparatus, not designated specially, correspond to the parts of the apparatus 17.

In FIGS. 6 through 8, another apparatus 37 is shown, which can be applied instead of the apparatus 17 in the texturing machine according to FIG. 1. The closed apparatus 37 consist of an upper part 38 connected to a machine frame part 16*a* and of a lower part 39, with one each of two texturing nozzles 2 and suction devices 40, respectively, held therein. In FIGS. 7 and 8, the apparatus 37 is shown in its opened state, with the ducts 41 and 41*a*, respectively, which in the closed state of the apparatus 37 surround the treatment chambers 13 substantially sealingly. The suction devices 40 (one only being shown in FIG. 7) are integrated parts of the member 38. For preventing lateral penetration of air from the surrounding room, seals 42 are provided on both sides and along the ducts 41 and 41*a*.

The other parts not designated specially correspond to the parts of the apparatus 17.

Threading in of a thread now is effected in the following manners:

I: The apparatus 17 is opened, the texturing nozzle 2 is pivoted from its texturing position A into the threading-in position B by action of the pneumatic cylinders 8, the activated mobile suction gun 18 is manually brought into the duct part 20 of the upper part 22 and is held there until the apparatus 17 is closed again. Using a second mobile suction gun 43 (FIG. 1), the thread 1 supplied by the pair of drawrolls 3 is brought via a deflecting device 46 and via positioning pins 47 (one only shown) substantially at right angle to the inlet opening 44 of the deactivated texturing nozzle 2 and into a cutting device 45 arranged below. In this thread position, the second mobile suction gun 43 is fixed relative to the room. Subsequently the thread is severed using the cutting device 45, where upon the thread passes via the texturing nozzle into the suction gun 18, and then the suction gun 18 again is held manually, the apparatus 17 is opened, the texturing nozzle is pivoted back to the position A and thread 1 is transferred to the cooling drum 15 and on to the further elements required in the texturing method using the suction gun 18.

II: In the use of the apparatus 29, the whole threading-in process is effected in analogy to the process steps described under I, with the difference, however, that two texturing nozzles are surrounded by the apparatus 29, and that two threads 1 can be threaded in simultaneously. The threads 1, which are sucked in by the suction gun 43 in common, but which are coming in separately from the pair of draw rolls 3 are brought via additional positioning pins (not shown) to a mutual distance corresponding to the distance between the nozzles, and in front of the texturing nozzles.

III. In the use of the apparatus 37, the threading-in of two threads, up to and including the step of severing the thread using the cutting device 45 is effected in analogy to the process described under I or II. Subsequently, however, as differing from the process described under I or II, the suction gun 43 is used upon opening the apparatus 37 for taking over the threads sucked in by suction devices 40. This is effected by sucking in one thread after the other using the suction gun 43 in the room E between the texturing nozzle and the suction device 40 and in severing with a conventional manual cutting device, such as a pair of scissors, between the suction gun 43 and the suction device 40.

Both threads thus taken over by the suction gun 43 are transferred, after the two texturing nozzles are pivoted back into the position A, onto the cooling drum 15, and as described earlier on to the further elements.

All steps described under I,II,III for threading in one or both threads, except the activation and movements of the mobile suction guns, can be effected automatically controlled by a control device (not shown) upon activating one single push-button (not shown) of this control device.

We claim:

1. A method of threading threads into at least two texturing nozzles movable between a texturing position and a threading-in position comprising the steps of moving each nozzle from said texturing position into said threading-in position;

drawing air simultaneously through a treatment chamber within each nozzle to draw air into and through an inlet opening of each nozzle into the treatment chamber;

engaging at least two moving threads in a mobile suction device;

guiding each engaged thread at a right angle in front of the thread inlet opening of a respective nozzle in said threading-in position; and cutting each thread between the mobile suction device and the respective inlet opening to permit the severed threads to be drawn through the respective inlet opening into the treatment chamber of a respective nozzle.

* * * * *

UNITED STATES PATENT AND TRADEMARK OFFICE

CERTIFICATE OF CORRECTION

PATENT NO. : 4,519,115

DATED : May 28, 1985

INVENTOR(S) : Peter Gujer, et al.

It is certified that error appears in the above—identified patent and that said Letters Patent is hereby corrected as shown below:

Column 1, line 52 change "elements" to - element-

Column 1, line 63 change "caughty" to -caught-

Column 4, line 7 change "where upon" to -whereupon-

Column 4, line 11 change "and thread 1" to -and the thread 1-

Signed and Sealed this

*Twenty-fourth* Day of *December 1985*

[SEAL]

*Attest:*

DONALD J. QUIGG

*Attesting Officer*

*Commissioner of Patents and Trademarks*